United States Patent [19]

Blanton

[11] Patent Number: 4,835,913

[45] Date of Patent: Jun. 6, 1989

[54] DEBURRING APPARATUS

[75] Inventor: Albert G. Blanton, Old Hickory, Tenn.

[73] Assignee: Avco Corporation, Nashville, Tenn.

[21] Appl. No.: 215,613

[22] Filed: Jul. 6, 1988

Related U.S. Application Data

[63] Continuation of Ser. No. 88,820, Aug. 24, 1987, abandoned, which is a continuation of Ser. No. 874,951, Dec. 31, 1986, abandoned, which is a continuation of Ser. No. 668,419, Nov. 5, 1984, abandoned.

[51] Int. Cl.[4] ..... B24D 13/06

[52] U.S. Cl. ..... 51/336; 51/76 R

[58] Field of Search ..... 51/74 R, 76 R, 78, 80 A, 51/87 R, 330, 331, 332, 334, 335, 336, 337

[56] References Cited

U.S. PATENT DOCUMENTS

| | | | |
|---|---|---|---|
| Re. 31,745 | 11/1984 | Pichelman | 51/330 |
| 1,722,724 | 7/1929 | Wegner | 51/74 R |
| 2,049,324 | 7/1936 | Schneider | 51/337 |
| 2,423,992 | 7/1947 | Nordgren et al. | 51/334 |
| 2,466,082 | 4/1949 | Craig et al. | 51/74 R |
| 2,816,403 | 12/1957 | Peterson | 51/337 |
| 2,826,776 | 3/1958 | Peterson | 51/336 |
| 2,984,053 | 5/1961 | Peterson | 51/337 |

FOREIGN PATENT DOCUMENTS

| | | | |
|---|---|---|---|
| 38696 | 3/1977 | Japan | 51/74 R |

*Primary Examiner*—Robert P. Olszewski

*Attorney, Agent, or Firm*—Irwin P. Garfinkle; Robert McNair

[57] ABSTRACT

An improved deburring brush is presented which is useful in processing aerospace parts of considerable length and surface complexity. The brush includes a cylindrical hub for providing support during use. A multiplicity of brush elements of the channel strip type are attached at regular intervals around the periphery of the hub. Attachment is typically by use of retaining strips which hold the brush strips in lengthwise channels cut in the hub surface. Each brush element includes a longitudinal metal strip bent into a generally U-shape to form a rear wall and two converging sidewalls. Bristle fibers are then laid side by side in a row, then collectively folded at their middles around a core wire for insertion into the U-shaped channel which is then compressed so that the sidewalls press against the multiplicity of protruding bristles. Each bristle is flexible and has impregnated therein a plurality of abrasive particles. The outwardly extending ends of each bristle readily flex in the plane of rotation. When the brush is set above the workpiece so that the bristle ends overlap the surface being deburred, each bristle makes a slapping contact therewith. To greatly improve the service life of the brush an elastomeric substance is applied to the surface of the bristles at and immediately adjacent the juncture of the bristles and the U-shaped channel in which they are clamped.

6 Claims, 3 Drawing Sheets

DEBURRING APPARATUS

This is a continuation of application Ser. No. 088,820 filed Aug. 24, 1987 now abandoned, which in turn was a continuation of abandoned application Ser. No. 874,951 filed on Dec. 31, 1986, which in turn was a continuation of abandonned application Ser. No. 668,419 filed on Nov. 5, 1984.

BACKGROUND OF THE INVENTION

An improved rotary brush for use in deburring apparatus is described. The brush is particularly suited to the small volume and large part complexity of the aerospace industry.

Several automated deburring systems exist in the prior art. However, the general status of the art is best presented in the book, "*Deburring Technology For Improved Manufacturing*", authored by LaRoux K. Gillespie, published by the Society of Manufacturing Engineers, One SME Drive, P. O. Box 930, Dearborn, Mich., 48128, Copyright 1981. This text discloses methods used either separately or in combination including: use of power driven brushes, vibration with abrasive media, flap wheels, buffing with Scotch-Brite pads and use of hand held devices. There is probably no particular process which will handle all applications. For any particular application the objective is to reduce labor costs and to provide an efficient and reliable means of deburring the machine edges of the component parts.

Catalog 280, Copyright 1980 available from The Osborn Manufacturing Corporation, Cleveland, Ohio lists a multiplicity of the brushes currently used in deburring and finishing machines. The prior art in abrading, brushing, finishing, polishing, scrubbing and general cleaning is disclosed in the following U.S. Pat. Nos. 2,653,340 to Cave; 3,032,931 to Eversole; 3,241,172 to Tilgner; 3,547,608 to Kitazawa; 3,605,347 to Barry; 4,078,905 to Oya; and 4,377,878 to Pecora. Relevant foreign patents include: Canada No. 527,791; No. 136,789—Japan; and No. 766,145—Great Britain.

These prior art brush deburring machines generally utilize brushes wherein the sharp tips of the filaments do the work. Use of large diameter, short filaments closely packed together make this type of brush more effective. Faster velocities make this class of brush more effective.

My invention utilizes a different concept. First, I make use of a rotary brush having nylon bristles filled with abrasive particles. Second, the free length of the bristle filaments are sufficiently long and hence flexible to provide the brush with a capability to conform to the irregular and contoured surfaces of the large structures found in the aerospace industry. Thus, in contrast with the prior art systems which utilize brushes having bristles which cut predominantly at the ends thereof, my system utilizes a brush having long flexible bristles which are displaced so that a wiping action rather than a tip cutting action occurs. The available prior art brushes are not able to accomplish this wiping action task in a cost effective manner.

SUMMARY OF THE INVENTION

The workpiece deburring apparatus of this invention utilizes a cylindrically shaped rotating brush having long bristles. The bristles are flexible and extend radially outward from a central hub. The bristles are attached to the hub by forming brush elements of the channel strip type. Each bristle comprises a flexible fiber filled with abrasive particles. As used the fibers were a product made by DuPont Corporation called "Tynex A". The fiber is manufactured by extruding nylon filled with an abrasive slurry to produce a monofilament yarn which exposes new abrasive surface as it wears.

A brush element of the channel strip type includes a longitudinal metal strip bent into a generally U-shape to form a rear wall and two converging sidewalls. Bristle fibers are then laid side by side in a row, then collectively folded at their middles around a core wire for insertion into the U-shaped channel which is then compressed so that the sidewalls press against the multiplicity of protruding bristles.

The hub is provided with a plurality of longitudinal recesses each shaped to receive the U-shaped metal channel portion of a brush element strip. The recesses and any clamping arrangements may have the brush strips disposed either parallel to the hub longitudinal axis or disposed in helical configuration. Both configurations are non-loading due to the nature of the nylon bristles.

With respect to the workpiece, it was desirable to accomplish automated deburring of large aerospace parts of considerable length, width and mass, such as wing planks having extensive exposed surfaces, relatively shallow pockets milled therein and generally rectilinear cutouts. Spars may extend from the surface and have lips at the outer edge to give added structural support. Part material may be aluminum, other metals or composites.

The deburring apparatus feeds the workpiece toward a work zone, mounts the brush for rotation about an axis generally transverse to the direction of feed of the workpiece and provides a means for adjusting the height of the brush relative to the surface of the workpiece.

Tests were conducted to optimize the process parameters using a small scale deburring machine. The parameters evaluated included the number of strips in the cylindrically shaped brush and the revolutions per minute at which the brush turns. Workpiece parameters evaluated included material type, height and direction of spars, overhang of spar caps, the spacing of the spars and the configuration of any holes in the workpiece. These tests were conducted using brushes made with 8 inch long bristle fibers. The total diameter of the brush was 22 inches. The fibers were all made from Tynex A. The abrasive material in the fibers was 80 grit silicon carbide.

The results of these tests showed that it is most effective to utilize a machine wherein the brush axis operates at a 45° angle to the edges to be deburred. Maximum material will be removed from the top, front and the rear edges of the spars when 20 brush strips are incorporated into each brush. This means that the brush strip is inserted every 18 degrees around the periphery of the roll. Tests show that there is maximum material removal when the rotational speed of the brush is in the range of 400 to 600 rpm. A nominal speed of 500 rpm was chosen as a good compromise. Satisfactory deburring was achieved on aluminum for workpiece feed rates between 3 and 12 feet per minute.

Spar heights in the test samples were 2.50 inches. Test data on the effect of spar spacing indicates that best results are obtained when the spacing between spars is at least 8 inches. The amount of material removed from the bottom front edge of spars having one inch wide caps indicates that the positioning of the brush roll above the conveyor is optimized when the tips of the fibers reach the surface of the conveyor.

Additional tests indicate that the brush diameter should be made proportional to the height of the spars extending from the surface of the workpiece. Short spars are effectively deburred using smaller diameter brush rolls than is needed when deburring longer spars.

During the tests it was discovered that a significant increase in the life expectancy of the brushes could be achieved. This discovery involves the application of an elastomeric substance to the juncture of the region where the bristle fibers emerge from the U-shaped channel. Prior to my invention, the long bristles fibers tended to break off at the point where the bristle emerged from the sidewalls of the U-shaped channels. The added support provided by the elastomeric material prevents the bristle fibers from being stressed beyond their yield points during the deburring procedure.

To accomplish my invention, I coat the root of each brush strip with Plasti-Dip, a product made by PDI, Inc. of 1458 West County Road C, St. Paul, Minn. 55113. This product is applied cold to the roots of each brush strip. After coating, the strips are air cured. The ultimate elongation of the Plasti-Dip product is between 300 and 400 percent. Once cured, the Plasti-Dip adheres tenaciously to the brush fibers providing a flexible support for each fiber. Tests show that the average lift of a brush after its roots were coated with Plasti-Dip increased from 5 hours to 28 hours based on an accelerated life test. In practice the newly produced brushes last upward of three months.

DETAILED DESCRIPTION OF THE PREFERRFED EMBODIMENT

Figure 1:
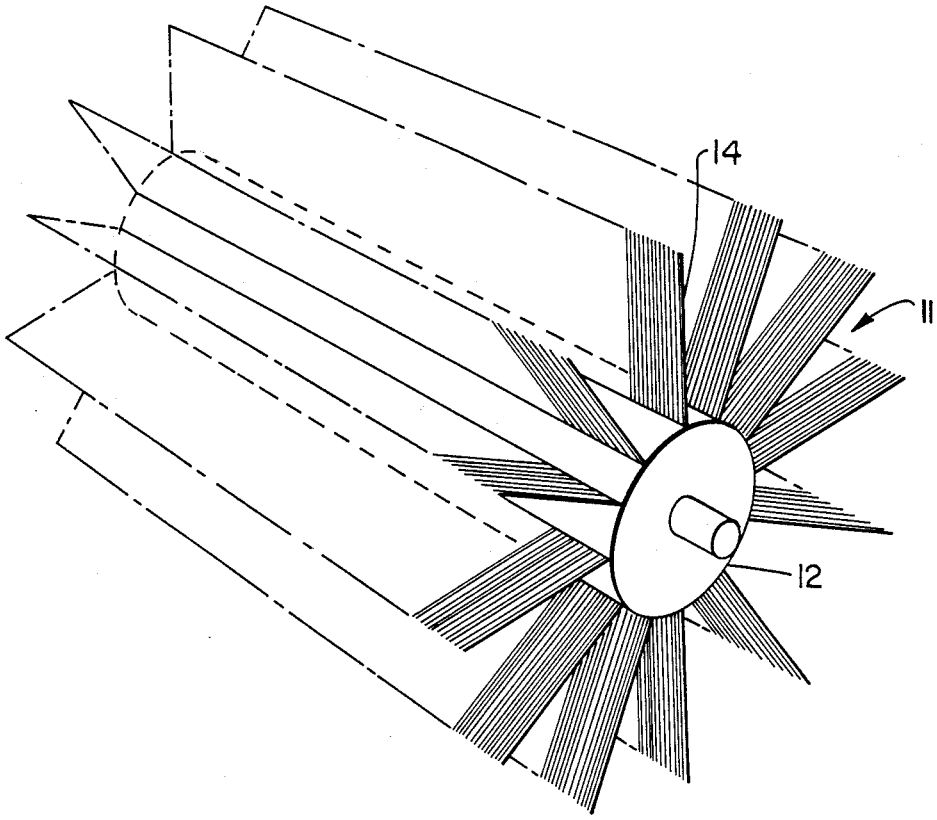
FIG. 1 is a perspective view of a brush formed in accordance with the principles of the invention.

Referring to the drawings, FIG. 1 shows a brush 11 consisting of a hub 12 which carries a multiplicity of channel strip type brush elements 14. In the unit reduced to practice, the bristle fibers of brush elements 14 extended outward about 8 inches from the point of strip attachment to the hub. The FIG. 1 brush is mounted for rotation on the deburring machine 15 shown in FIG. 2. Deburring machine 15 is comprised of vertical and horizontal frame members 16 and 18 which support drive motor 20. Between top rails 22 and 23, a series of six driven rollers 24 serve to convey a workpiece from right to left as viewed in FIG. 2. It will be understood that motor 20 is connected by appropriate shafts and gearing to rotate brush 11 and rollers 24 at the desired counterclockwise speeds.

Figure 3:
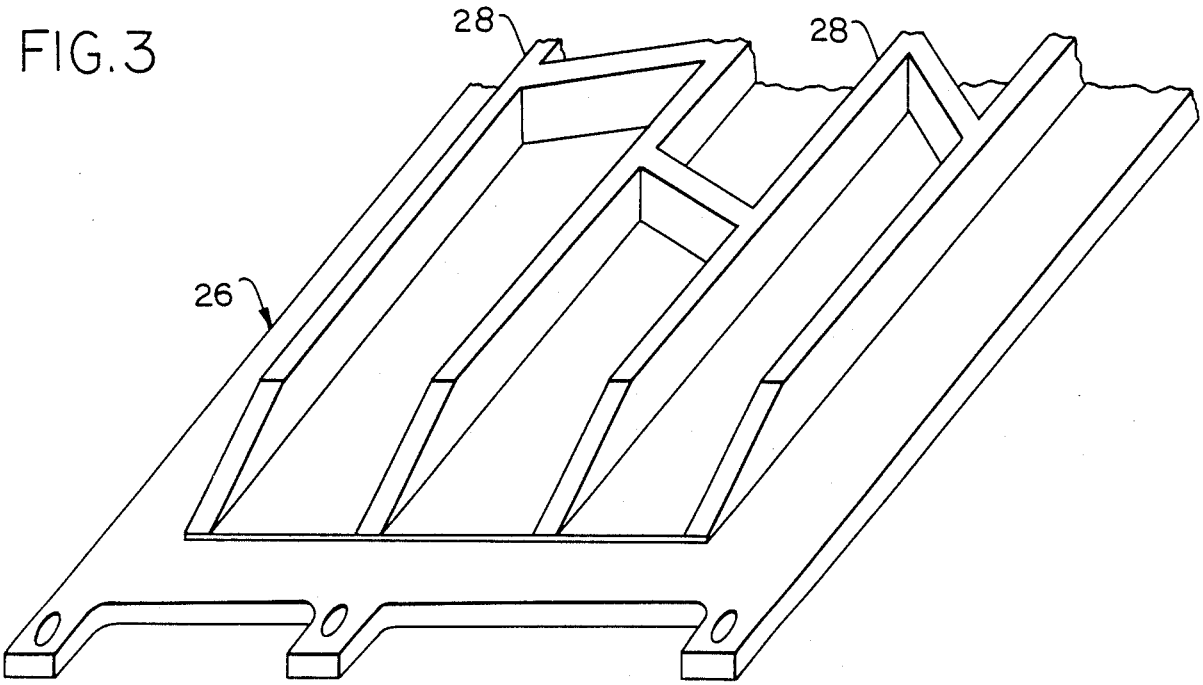
FIG. 3 is a perspective view of a typical aerospace workpiece which can be deburred by the FIG. 2 machine.
Figure 2:
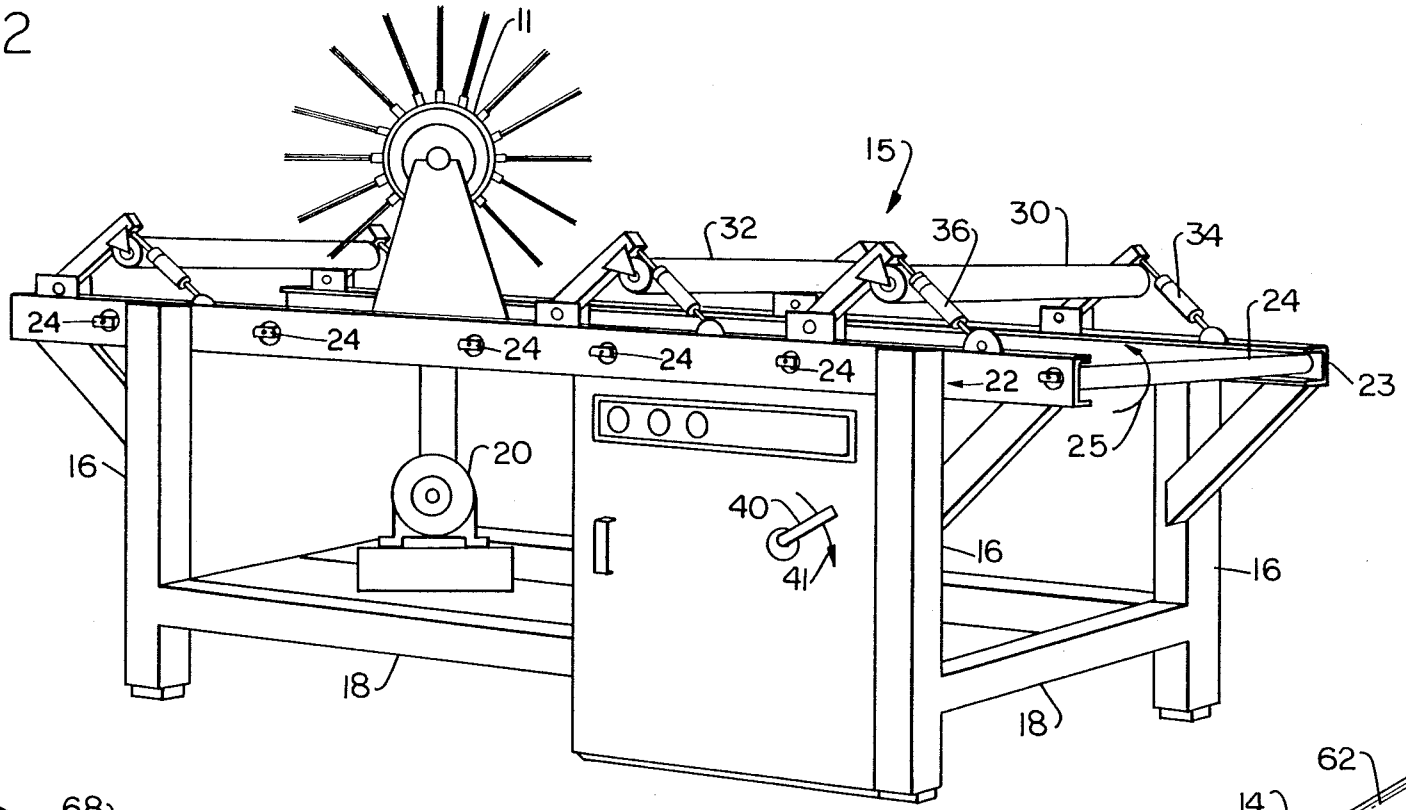
FIG. 2 is a perspective view of a machine which utilizes the brush of FIG. 1 in carrying out the deburring task.

FIG. 3 shows a perspective view of a typical milled extrusion 26 which can be deburred by machine 15 shown in FIG. 2 Each of the four spars shown in FIG. 3 has two sharp edges along its top surface. The FIG. 3 extrusion 26 might represent a wing plank of an airplane. As received from the milling machine the extrusion would be fed into the right hand end of the deburring machine 15 shown in FIG. 2. As the extrusion enters machine 15 top side rollers 30 and 32 would make contact with the uppermost side of extrusion 26. This would mean that rollers 30 and 32 contact the uppermost surfaces of spars 28. Air pistons 34 and 36 actuate arms which bring rollers 30 into contact with the topmost surface of the spars. The surface of the rollers 30 and 32 may be covered with neoprene or equivalent to insure that the workpiece being deburred is not scratched or scuffed. Driven rollers 24 turning as shown by arrow 25 will carry the workpiece through the machine allowing brush 11 to accomplish the deburring task. Brush 11 has its axis oriented at 45 degrees with respect to linear travel of the workpiece through machine 15. By orienting the axis of brush 11 at 45 degrees with respect to the direction of travel of the workpiece there will always be a transverse component of motion between the bristle fibers and the sharp upward facing edges of the spars.

For the deburring system reduced to practice, the automatic conveyor unit included switches for starting and sequencing events. Once the workpiece is loaded into machine 15 the operator rotates lever 40 in a clockwise direction shown by the arrow 41 to initiate the deburring sequence. For the machine reduced to practice, nominal speed of rotation of brush 11 was 500 rpm. Rollers 24 were geared to provide a workpiece speed rate of about 3 ft. per minute through the machine.

Figure 4:
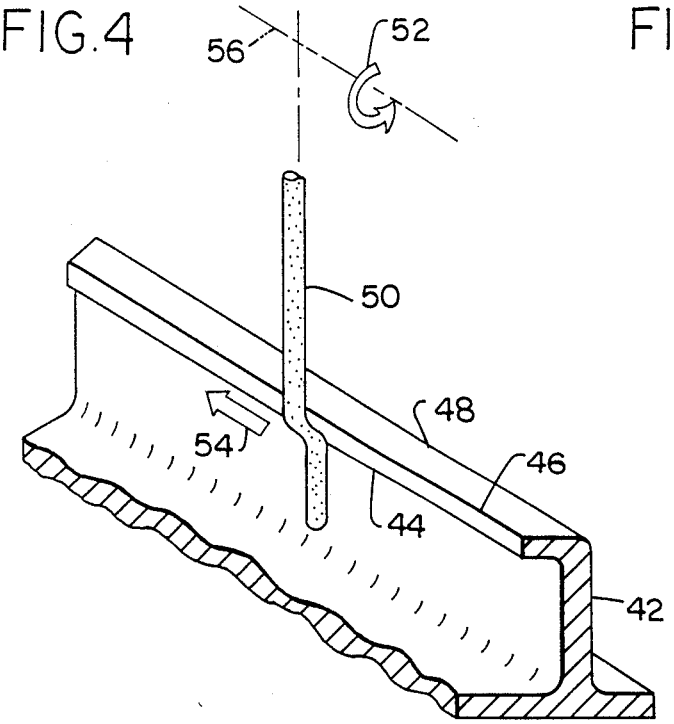
FIG. 4 depicts an abrasive bristle fiber in contact with the upward projecting spar of a workpiece.
Figure 5:
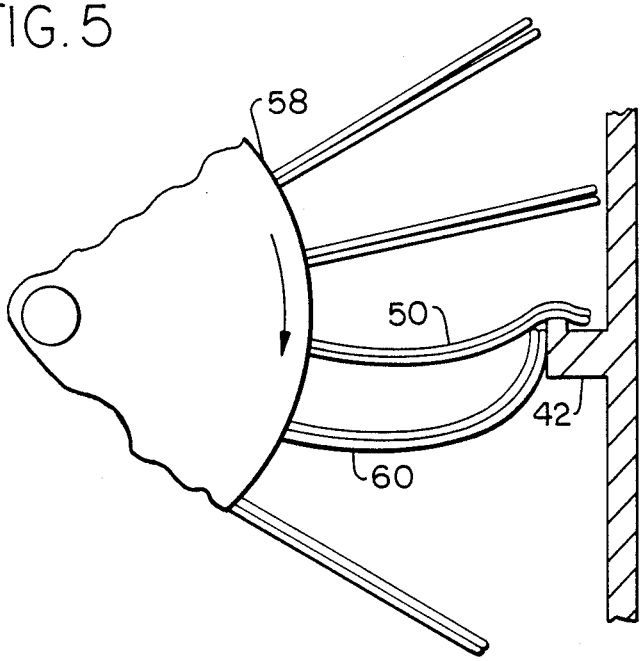
FIG. 5 shows partial end view of a brush having bristle fibers in overlapping contact with a workpiece.

FIG. 4 shows a fragmentary view of a milled extrusion 42 having sharp edges 44, 46 and 48 to be deburred. In essence this amounts to an upward facing spar with a cap along the top edge. One bristle 50 from a FIG. 1 brush 11 is shown in contact with milled edges 26 and 28. It is assumed that the hub to which bristle 50 is attached turns so as to move the bristle in the direction shown generally by arrow 42. The workpiece of which milled extrusion 42 forms a part is assumed to be moving in the direction shown by arrow 54. Thus, due to rotation of the brush around axis 56 and transverse motion of milled extrusion 42, bridge 50 will make a slapping overlapping contact along edges 44 and 46. Then as the bristle fiber swings counterclockwise around its axis, it will be dragged endwise over the edges of the spar cap. This action is also shown in the end view of FIG. 5. Bristle 50 of brush 58 is shown in the same position as depicted in FIG. 4. Bristles 60 of the strip brush element just ahead of the brush element containing bristle 50 are shown as being dragged over the top of the spar cap. As bristles 60 drop off the downstream edge of the spar cap, deburring of that edge will be accomplished. It was found important to space out the brush element strips around the hub so that no interference occurred between adjacent bristle strips. In the unit reduced to practice wherein 8 inch long bristle fibers were utilized, a spacing of 18 degrees between strips gave satisfactory results. A spacing between strips of 18 degrees results in a brush with 20 brush element strips.

Figure 6:
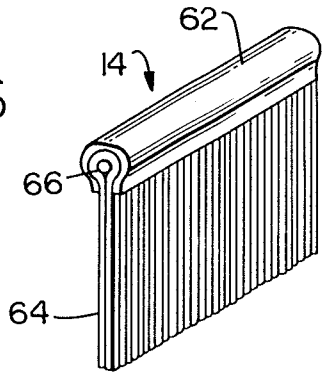
FIG. 6 shows a perspective view of a length of a brush strip suitable for use in this invention.
Figure 7:
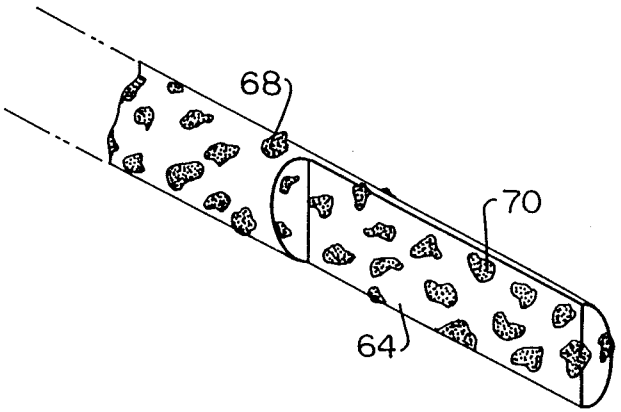
FIG. 7 is a cutaway view of one of the abrasive fibers.

FIG. 6 depicts a porition of a brush strip 14 comprising a longitudinal strip 62 which is preferably of sheet metal. The bristle fibers 64 after being laid side by side in a row are then collectively folded around a core retaining member 66 of metal or cord such as nylon. The U-shaped channel 62 is then compressed so that the sidewalls press against the multiplicity of protruding bristles 64. The composition of the brush bristles 64 are more clearly shown in the enlarged view of FIG. 7 which depicts a cutaway view of the interior. On the left abrasive particles 68 extend through the surface of the nylon resin. In the cutaway portion on the right, abrasive particles 70 are shown to be impregnated throughout the interior of the bristle fiber. Thus, as the resinous material wears away during the deburring action, abrasive material will continue to make contact with the workpiece.

Figure 8:
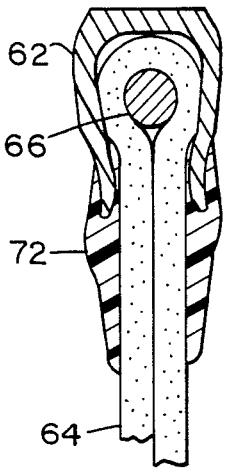
FIG. 8 shows an enlarged cross section of the FIG. 6 brush strip which has been reinforced with an elastomer.

FIG. 8 shows an enlarged cross sectional view of the root portion of the channel strip type brush element depicted in FIG. 6. The center bent portion of abrasive impregnated bristle 64 is shown encircling core member 66. The multiplicity of bristle fibers 64 making up the brush element are shown clamped within U-shaped channel member 62. The juncture of the bristle fibers and the U-shaped channel is then coated with an elastomer 72. In the unit reduced to practice the juncture of the U-shaped channel 62 and the region where the bristles 64 emerge from the channel was coated with Plasti-Dip. This product was applied cold to the roots of each brush strip element. After coating, the strips were allowed to air cure. Once cured, the Plasti-Dip was found to adhere tenaciously to the brush fibers. This provided a flexible support and at the same time served to strengthen the clamped base or root portion of the fibers and extend the life expentancy of the brush element. The reason that the Plasti-Dip added to the life of the brush results from the reduction of bristle flexing at the point where they are clamped by the U-shaped channel.

Figure 9:
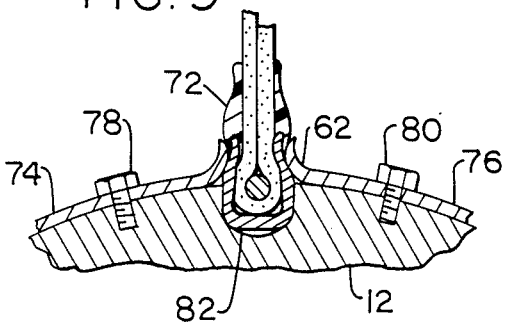
FIG. 9 is an enlarged partial end view of a brush hub showing one means of attaching the brush strips.

One means of mounting the brush elements to the central hub is shown in FIG. 9. Retaining strips 74 and 76 are positively attached to hub member 12 by means of bolts 78 and 80. Each brush element will fit in a channel 82 cut into the surface of the hub element 12. Thus, for a brush having 20 brush elements of the channel strip type, there will be 20 of the channel slots 82 recessed into the surface of the hub at regular intervals. These recesses may be either straight along the hub and parallel to the axis thereof or they may be disposed in a helical situation. The retaining strips 74 and 76 have flared edges at the point of contact with the brush elements strips. The retaining strips are formed so as to contact the brush strip in a flared manner along the channel backing element near the base. They will also make contact with the elastomer fill material 72. Contacted in this manner the brush element strips will be securely anchored to the hub, yet will be readily replaced on removal of bolts 78 and 80.

Figure 10:
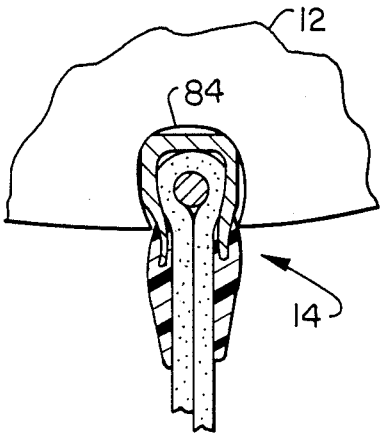
FIG. 10 is an enlarged partial end view of a brush hub showing an alternate means of attaching brush strips.

FIG. 10 shows an alternate means of attaching the brush strip elements 14 to hub member 12. In th FIG. 10 configuration, slots 84 are formed in the hub member 12. Slots 84 hold the brush elements without need for any exterior clamping elements. With this type of slot the brush elements are pressed in form the end of the hub and will be retained therein during the course of operation. With this type of implementation it may be necessary to use adaptor flanges at both ends of the brush to hold the brush strips in place during operation.

While my invention has been disclosed using a brush having long bristles composed of nylon fibers impregnated with abrasive particles, the use of nylon fibers is intended only as being exemplary. The prime criteria is to use a somewhat flexible material that is both wear resistant and capable of being filled with abrasive particles during the forming operation. The size and hardness of the abrasive particles will be chosen as a function of the type of workpiece being deburred. Pack density determines number of bristles per inch. Coating material flows between bristles and binds them together. During the deburring operation each bristle acts as a leaf spring as it slaps against and is subsequently dragged across the upward facing spars and openings of the workpiece being deburred. This leaf spring action differs from the multiple tuft type channel strip brush element disclosed by Cave (U.S. Pat. No. 2,653,340). The multiple tuft type brush element resists lateral bending or distortion due to the mutual support of the multiplicity of bristles across each strip. Because each bristle in my deburring bush acts like an unsupported leaf spring, maximum stress occurs at the juncture of the bristles and the hub. With my invention of the addition of an elastomer to the juncture of the bristle and the hub, stresses are relieved and the life of the brush is greatly extended. Merely potting the bristles in the channel strip would not accomplish the desired result. It is only through the utilization of an elastomer capable of distributing and dissipating stresses that the improved results will be achieved.

Deburring brushes built in accordance with my invention will also be equally useful in robotic deburring. By attaching my brush to the rotating arm of a robot, it will be possible through computer control to deburr workpiece configurations having complex shapes and deeply machined pockets. Numerical control of robot arms provides practically unrestricted movement of the brush across the surface of the workpiece. Consequently the bristle fibers for use with a robotic procedure can be of a shorter length than that illustrated in the embodiment described above.

While only a single embodiment of the invention has been presented, various modifications will be apparent to those skilled in the art. For example, both the brush length and the length of the bristles thereon may be changed to fit operating conditions. Therefore, the invention should not be limited to the specific illustration disclosed, but only by the following claims.

I claim:

1. An improved brush for use in combination with apparatus for deburring a workpiece having structural length and surface complexity including one or more edges, said apparatus comprising:

a rotatable brush having a plurality of radially extending discrete groups of long flexible bristles of fibrous material, said material having abrasive particles imbedded therein and distributed throughout said bristles, each of said bristles having tips and an elongated working section extending from said tips and terminating in a root;

means for rotating said brush and for moving said workpiece and the working sections of said bristles into contact such that an elongated portion of each working section contacts said workpiece and is dragged across the workpiece when the brush is rotated, and when the brush and workpiece are linearly moved with respect to one another, whereby the working sections of said bristles are slapped against and dragged over the workpiece and wipe said edge and the surface forming said edge;

said improved brush comprising a hub rotation on its axis, said hub having a plurality of circumferentially spaced axially extending slots, the roots of said bristles being secured within said slots and spaced in a single layer along the length thereof, the population density of the bristles and the spacing between said slots permitting flexing of the working sections into contact with said workpiece in a direction transverse to the axis of rotation of the brush to provide conformance with workpiece surface contours said elongated working sections of said bristles being substantially unsupported by adjacent bristles, and an elastomeric material applied to and between the bristles at the junction of the roots and hub, said elastomeric material extending a short distance from said root toward said working section, said bristles being bounded together by said elastomeric material only at said roots.

2. The invention as defined in claim 1, wherein are provided channel members complementary to said axial slots, and securely insertable therein;

a core within each channel member, said core extending the full length of said channel member; and each of said plurality of bristles being wrapped with one half turn around said core to form said root, said bristles being spaced in a single layer along the full length of said core, said elastomeric material being applied to said bristles at the junction of said bristles and said channel members.

3. The invention as defined in claim 1 wherein the bristles have a free unsupported length of at least 7 inches.

4. The inventions as defined in claim 3, wherein the elastomeric material has an ultimate elongation of at least 300 per cent.

5. An improved brush comprising:

a hub rotatable on its axis, said hub having a plurality of circumferentially spaced axially extending slots;

a plurality of radially extending discrete groups of long flexible bristles of fibrous material, said material having abrasive particles imbedded therein and distributed throughout said bristles, each of said bristles having tips and an elongated working section extending from said tips and terminating in a root, the roots of said bristles being secured within said slots and spaced in a single layer along the length thereof, the population density of the bristles and the spacing between said groups permitting flexing of the working sections to provide conformance with the surface contours of a work piece, the elongated working sections of said bristles being substantialy unsupported by adjacent bristles; and an elastomeric material applied to and between the bristles at the junctions of the roots and hub, said elastomeric material extending a short distance from said root toward said working section, said elastomeric material bonding said bristles together only at said roots.

6. The invention as defined in claim 5, wherein are provided channel members complementary to said axial slots, and securely insertable therein;

a core within each channel member, said core extending the full length of said channel member; and each of said plurality of bristles being wrapped with one half turn around said core to form said root, said bristles being spaced in a single layer along the full length of said core, said elastomeric material being applied to said bristles at the junction of said bristles and said channel members.

* * * * *